US008479715B2

(12) United States Patent
Bertilsson et al.

(10) Patent No.: US 8,479,715 B2
(45) Date of Patent: Jul. 9, 2013

(54) INTERNAL COMBUSTION ENGINE WITH A FIRST AND SECOND COOLING SYSTEM

(75) Inventors: Bert-Inge Bertilsson, Floda (SE); Lennart Åberg, Stenungsund (SE)

(73) Assignee: Volvo Lastvagnar AB, Göteborg (SE)

( * ) Notice: Subject to any disclaimer, the term of this patent is extended or adjusted under 35 U.S.C. 154(b) by 350 days.

(21) Appl. No.: 13/003,578

(22) PCT Filed: Jul. 11, 2008

(86) PCT No.: PCT/SE2008/000445
§ 371 (c)(1),
(2), (4) Date: Mar. 8, 2011

(87) PCT Pub. No.: WO2010/005347
PCT Pub. Date: Jan. 14, 2010

(65) Prior Publication Data
US 2011/0283978 A1 Nov. 24, 2011

(51) Int. Cl.
*F02B 47/08* (2006.01)
*F02M 25/07* (2006.01)

(52) U.S. Cl.
CPC ..... *F02M 25/0707* (2013.01)
USPC ..... 123/568.12; 123/573

(58) Field of Classification Search
USPC ..... 123/41.31, 563, 568.13, 126; 60/599; 165/41–43, 51
See application file for complete search history.

(56) References Cited

U.S. PATENT DOCUMENTS

| | | | | |
|---|---|---|---|---|
| 4,984,539 | A * | 1/1991 | Shinoda et al. | 123/41.42 |
| 5,687,688 | A * | 11/1997 | Tsunoda et al. | 123/196 W |
| 6,167,999 | B1 * | 1/2001 | Reik et al. | 192/55.1 |
| 6,182,809 | B1 * | 2/2001 | Reik et al. | 192/55.1 |
| 6,422,217 | B1 * | 7/2002 | Feucht et al. | 123/568.11 |
| 8,225,901 | B2 * | 7/2012 | Ohtsuki et al. | 180/312 |
| 2002/0073978 | A1 | 6/2002 | Feucht et al. | |

FOREIGN PATENT DOCUMENTS

| | | |
|---|---|---|
| GB | 2127487 A | 4/1984 |
| JP | 06317149 A | 11/1994 |

OTHER PUBLICATIONS

International Search Report for corresponding International App. PCT/SE2008/000445.
International Preliminary Report on Patentabiity for corresponding Interantional App. PCT/SE2008/000445.

* cited by examiner

*Primary Examiner* — Stephen K Cronin
*Assistant Examiner* — Gonzalo Laguarda
(74) *Attorney, Agent, or Firm* — WRB-IP LLP

(57) ABSTRACT

A cooling structure for cooling a liquid-cooled internal combustion engine is provided where the engine includes an EGR passage interposed between an exhaust manifold structure and an inlet manifold structure of the engine. The cooling structure includes a first cooling system and a second cooling system. The first cooling system includes at least one radiator and a liquid coolant circulatable through the radiator and the internal combustion engine for cooling the internal combustion engine. A flywheel housing for the internal combustion engine is provided with at least a portion of the second cooling system.

10 Claims, 2 Drawing Sheets

INTERNAL COMBUSTION ENGINE WITH A FIRST AND SECOND COOLING SYSTEM

BACKGROUND AND SUMMARY

The present invention relates to a cooling structure for an internal combustion engine.

Cooling structures for cooling engines, lubricant oil, transmission oil, fuel, charged air and/or EGR fluids are associated with radiators or heat exchangers. In modern vehicles space is becoming more and more critical, i.e., there is a need for compacting the accessories belonging to an internal combustion engine due to very restricted space available. Engine compartment space is especially critical for heavy vehicles where every cm required for the engine and its accessories may intrude on the available space for other features on the heavy vehicle, or even worse intruding on the total stowage space.

For instance, a conventional EGR cooling structure comprises EGR pipes, coolant pipes and an EGR cooler. The EGR cooler as such is for a heavy vehicle approximately 5 dm3 and has a weight of 15 kg. The EGR cooling structure is traditionally arranged in the vicinity of an exhaust manifold of the internal combustion engine, i.e., to the left or the right side of an engine block. It is necessary to provide space for installing such EGR cooling structure and/or charge air cooling structure and/or lubricant oil cooling structure and/or transmission oil cooling structure and/or fuel cooling structure in the engine compartment together with other components provided on or beside said engine. However, with the decreasing space available this has proven to be a problem.

It is desirable to provide a cooling structure in addition to the internal combustion engine coolant system which is more compact compared to the conventional structures.

According to a first aspect of the invention it is provided a cooling structure for cooling an liquid-cooled internal combustion engine where said engine comprises an EGR passage interposed between an exhaust manifold structure and an inlet manifold structure of said engine, said cooling structure comprising a first cooling system and a second cooling system, where said first cooling system comprises at least one radiator and a liquid coolant circulatable through said radiator and said internal combustion engine for cooling said internal combustion engine, characterized in that a flywheel housing for said internal combustion engine is provided with at least a portion of said second cooling system.

An advantage of this aspect is that the installation is compact and utilizes unused space provided in or by said flywheel housing.

Another advantage with said embodiment is that it may save weight compared to conventional assemblies.

In another example embodiment said second cooling system comprises at least one heat exchanger for cooling one or more of the following: charged intake air, lubricant engine oil, transmission oil, fuel, exhaust gases.

An advantage with said example embodiment is that space requiring heat exchangers may be provided at least partially in said flywheel housing.

In another example embodiment a cooler in said second cooling system is provided as a separate unit inside said flywheel housing.

An advantage with said example embodiment is that the manufacturing cost may be minimized together with a very compact design.

In still another example embodiment said cooler in said second cooling system is at least partially integrated in said flywheel housing.

An advantage of this embodiment is that the second cooling system can be even further compacted and total weight may be reduced.

In yet another example embodiment said flywheel housing is provided with cooling fins on the inside and/or the outside of said flywheel housing.

An advantage with this embodiment is that the flywheel housing may be used as a cooler itself.

In still another example embodiment at least a portion of an EGR passage and/or fuel passage and/or transmission oil passage and/or lubricant engine oil passage and/or charged intake air passage is integrated in said flywheel housing.

An advantage of this embodiment is that only short passages for said fluids may be needed outside the flywheel housing which may decrease the risk of leakage and further decreases the need of space. Another advantage is that total weight may be decreased.

In still another example embodiment of the present invention at least a portion of a liquid coolant passage is integrated in said flywheel housing.

An advantage with this embodiment is that only short liquid coolant passages are needed outside the flywheel housing which may decrease the risk of leakage and further decreases the need of space. Another advantage is that total weight may be decreased.

In still another example embodiment of the present invention a pump for circulating said liquid coolant is provided in said flywheel housing.

An advantage of this embodiment is that the space needed for an external pump may be used for other purposes.

In still another example embodiment said pump is mechanically driven by a belt from a flywheel.

An advantage with this embodiment is that no external driving means outside the flywheel is needed for pumping the liquid coolant.

In still another example embodiment of the present invention said pump is electrically driven.

An advantage with this embodiment is that the pump may be oriented at any available position in said flywheel housing without taking into account any mechanical driving means such as the flywheel.

In still another example embodiment of the present invention said pump is driven by a gearwheel connectable to the flywheel.

An advantage with this embodiment is that the teeth that may be available on the outer periphery of the flywheel to be connectable with the starting device may also be used for driving the pump.

In yet another example embodiment of the present invention said first and second cooling system is connected in series and uses the same liquid coolant.

An advantage with this embodiment is that one single liquid coolant may be used.

In still another example embodiment of the present invention said first and second cooling system is connected in parallel and uses the same liquid coolant.

An advantage with this embodiment is that liquid coolant from one system do not affect the other system.

in still another example embodiment of the present invention said first and second cooling systems are two separate cooling systems with separate liquid coolants.

An advantage of this embodiment is that the two systems are totally independent of each other.

BRIEF DESCRIPTION OF THE DRAWINGS

The present invention may best be understood from the following detailed description of the embodiments, but not restricted to the embodiments, wherein is shown schematically.

DETAILED DESCRIPTION

Figure 1A:
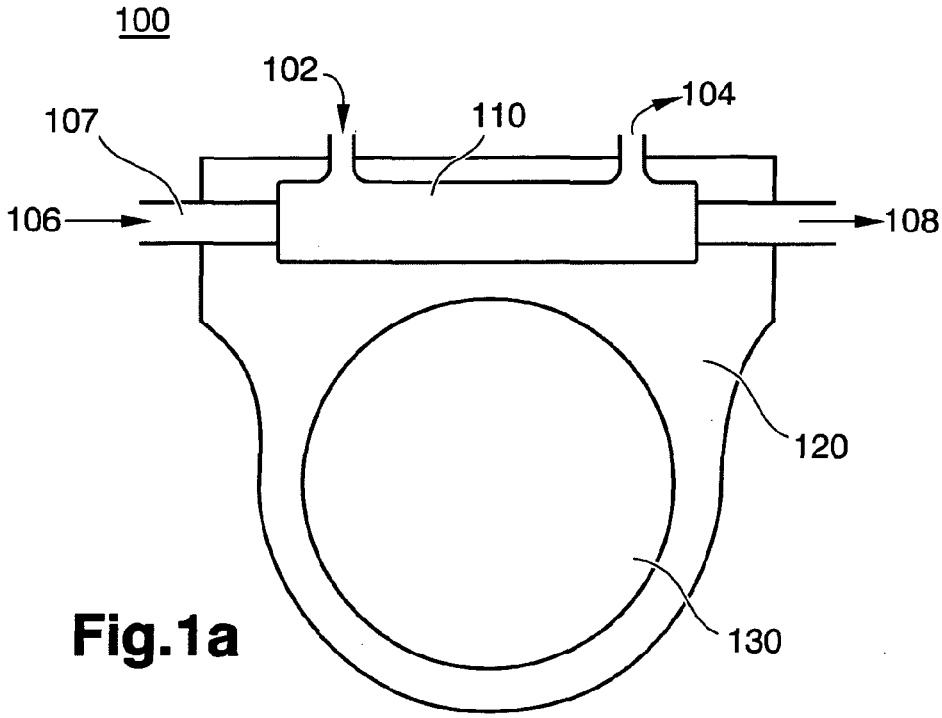
FIG. 1*a* is a side view of a first example embodiment of a part of a cooling structure according to the present invention.

FIG. 1*a* depicts schematically a first example embodiment according to the present invention of a cooling structure for cooling a liquid-cooled internal combustion engine. Said engine comprises an EGR passage 107 interposed between an exhaust manifold structure 280 (see FIG. 2) and an inlet manifold structure 270 (see FIG. 2) of said engine. Said cooling structure comprising a first cooling system for cooling said internal combustion engine (not shown) and a second cooling system 100 for cooling said EGR gases. A flywheel housing 120 for said internal combustion engine is provided with at least a portion of said second cooling system 100.

The invention is illustrated by means of an EGR heat exchanger provided at least partially in said flywheel housing. It should be understood that the inventive concept is equally applicable to the other heat exchangers for cooling charged intake air, lubricant engine oil, and/or transmission oil.

The meaning of the wording that a flywheel housing for said internal combustion engine is provided with at least a portion of said second cooling system is that said second cooling system could be a separate unit provided inside said flywheel housing; that said second cooling system is integrated in said flywheel housing or a combination of being integrated and a separate unit.

Said EGR passage 107 has an EGR inlet 106 and an EGR outlet 108. An EGR-cooler 110 is provided with an EGR liquid coolant inlet 102 and an EGR liquid coolant outlet 104. A flywheel 130 is provided inside the flywheel housing 120.

The EGR-cooler 110 in said second cooling system 100 may, in one example embodiment, be provided as a separate unit inside said flywheel housing according to FIG. 1*a*.

Figure 1B:
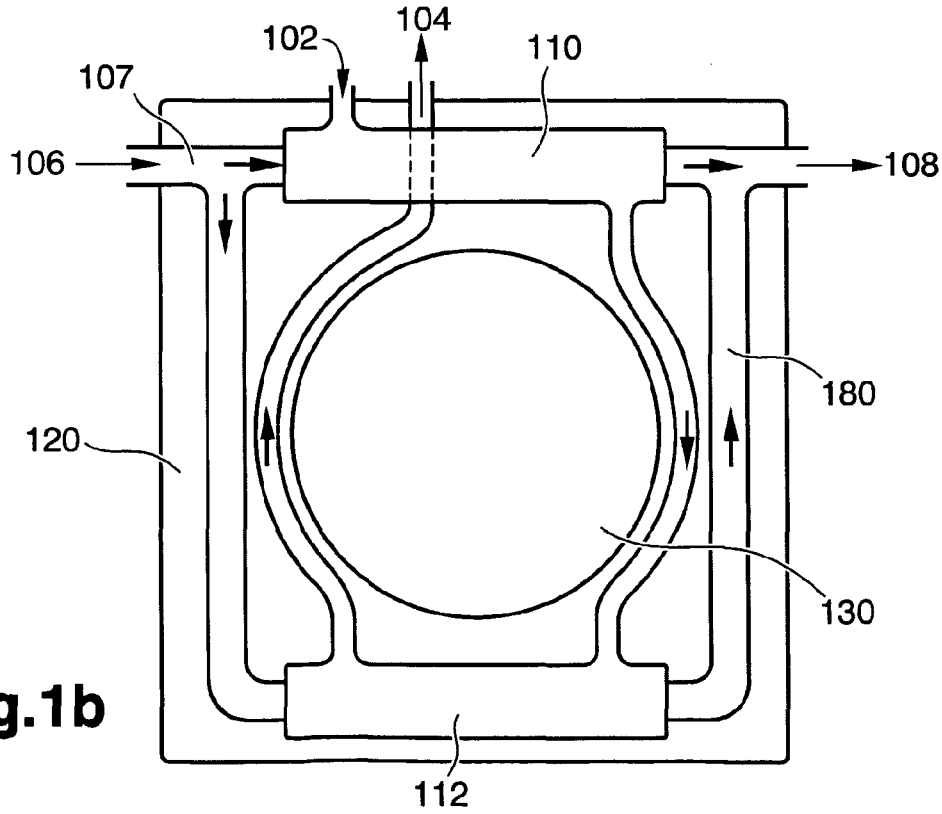
FIG. 1*b* is a top view of the first example embodiment of a part of a cooling structure according to the present invention.

The EGR-cooler 110 in said second cooling system 100 may in another example embodiment be at least partially integrated in said flywheel housing 120. This means that a portion of a passage for liquid coolant 180 may be integrated in the flywheel housing. In another example embodiment at least a portion of an EGR passage may be integrated in said flywheel housing 120. In still another example embodiment at least a portion of the passage for liquid coolant 180 may be integrated in the flywheel housing as well as a portion of an EGR passage in said flywheel housing 120 as depicted in FIG. 1*b*. In FIG. 1*b* it is illustrated that a first EGR-cooler 110 and a second EGR cooler 112 are provided inside said flywheel housing 120. The EGR-cooler may be a separate unit or integrated with the flywheel housing 120.

The flywheel housing 120 may comprise cooling fins (not shown) on the inside of said flywheel housing and/or provided on the outside of said flywheel housing 120 for improving the cooling a liquid coolant and/or said EGR gases. By integrating sufficient length of a fluid passage for a liquid coolant and one or more of the following fluids: exhaust gases, engine lubricant oil, transmission oil, fuel, charged intake air, said flywheel housing may serve as a heat exchanger as such.

A pump for circulating said liquid coolant may be provided inside said flywheel housing. Said pump may be mechanically driven by a belt from the flywheel 130. Said pump may also be electrically driven. It may also be possible to connect the teeth on the outer periphery of the flywheel which is normally used to connect a starter for the internal combustion engine to a gearwheel of the liquid fluid pump. This direct mechanical connection by gearwheels from the flywheel to the pump may always be in contact with each other or may be connectable to each other via a clutch or solenoid when circulation is needed.

The first cooling system for cooling the internal combustion engine and the second cooling system may be connected in series or in parallel and using the same liquid coolant. Another possibility is to separate the first and second cooling systems to be totally independent from each other. When using two separated cooling systems one may use one liquid coolant in the first system and another liquid coolant in the other system.

The flywheel housing may be manufactured in aluminum or any other material which is suitable for a casting or a form moulding process. The passages for exhaust gases and/or liquid coolant which may be present in said flywheel housing may be formed at the same time as the flywheel housing is formed. This may be done according to a process similar to making cylinder blocks. Said passages for exhaust gases and/or liquid coolant may also be manufactured after said flywheel housing has been finalized, i.e., the passages may be formed by drilling. Another method of making the passages a part of the flywheel housing is to make said flywheel housing in more than one part. One part of the passage may be formed in a first half and the other part of the passage in the second half. The passages may be formed during manufacturing of the parts as such or afterwards. When making the passages divided between said first and second parts other methods of forming those passages afterwards may be used such as with a laser, by milling, water carving. The cooling fins may also be manufactured at the same time as the flywheel as such or afterwards by suitable tools.

Figure 2:
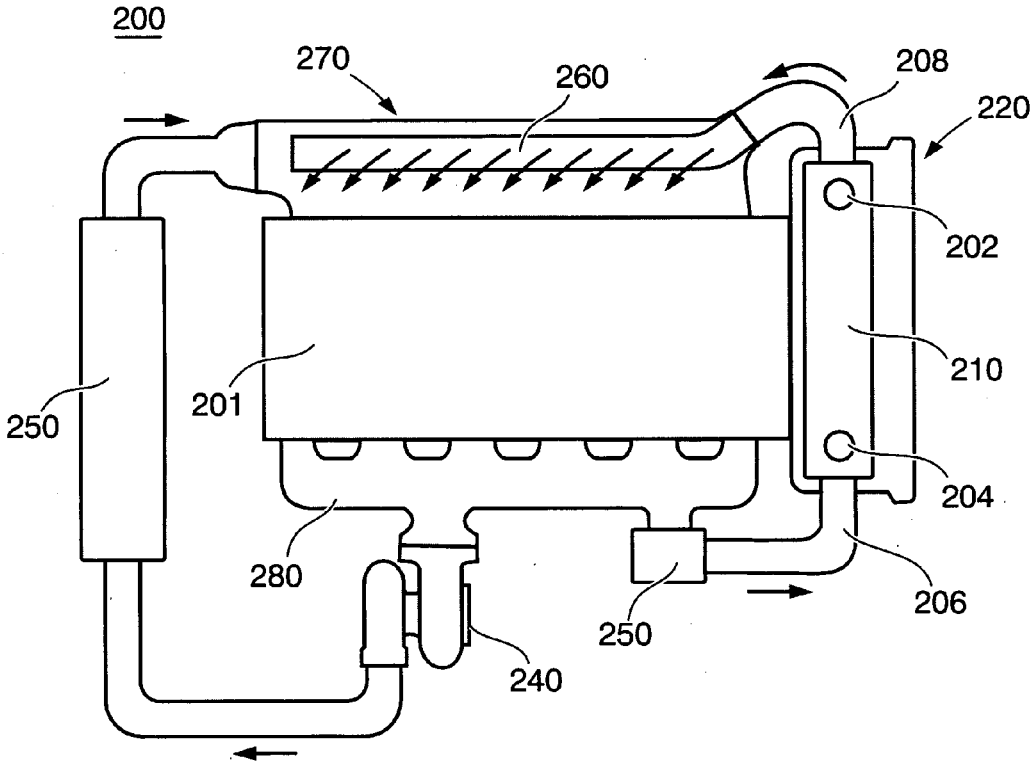
FIG. 2 is a side view of a second example embodiment of a part of a cooling structure according to the present invention.

FIG. 2 illustrates a top view of the same example embodiment as depicted in FIG. 1*a*. In FIG. 2 the internal combustion engine 201 is connected to the flywheel housing 220. Exhaust from the internal combustion engine 201 is delivered through an exhaust manifold 280 to a turbo 240 and then to the exhaust system (not shown). Exhaust gases may also be transported from the exhaust manifold 280 via an EGR valve 250 to the EGR-inlet 206 of the EGR cooler 210. Exhaust gases from the EGR cooler is then delivered from the EGR-outlet 208 to the inlet manifold 270 via an EGR distributor 260. The EGR distributor may take many different forms and is here illustrated to be a long pipe provided with many holes inserted in the inlet manifold 270. This may improve the mixing of inlet air and exhaust gases before entering a combustion chamber. Inlet air is provided to the inlet manifold 270 from the turbo 240 via a charge air cooler 250. In this embodiment only one turbo is shown, obviously two or more turbos may also be used, either provide in series or in parallel to each other. The EGR valve is operated according to well known knowledge and therefore needs no further explanation here.

The cooling structure may be provided in a vehicle such as a lorry, truck, bus, personal car, wheel loader, construction equipment vehicles etc.

The invention may be applied to any internal combustion engine such as diesel engine, gasoline engine, bifuel/flexifuel engine with one or a plurality of cylinders.

The invention must not be regarded as being limited to the examples of embodiment described above, a number of further variants and Modifications being feasible without departing from the scope of the following claims.

The invention claimed is:

1. A cooling structure for cooling an liquid-cooled internal combustion engine where the engine comprises an EGR passage interposed between an exhaust manifold structure and an inlet manifold structure of the engine, the cooling structure comprising a first cooling system and a second cooling system, where the first cooling system comprises at least one radiator and a liquid coolant circulatable through the radiator and the internal combustion engine for cooling the internal combustion engine, wherein the first and second cooling system are two separate cooling systems with separate liquid coolants, a flywheel housing for the internal combustion engine is provided with at least a portion of the second cooling system wherein at least one heat exchanger in the second cooling system is at least partially integrated in the flywheel housing for cooling one or more of the following: charged intake air, lubricant engine oil, transmission oil, fuel, exhaust gases.

2. The cooling structure according to claim 1, wherein the heat exchanger in the second cooling system is provided as a separate unit inside the flywheel housing.

3. The cooling structure according to claim 1, wherein the flywheel housing is provided with cooling fins on the inside and/or the outside of the flywheel housing.

4. The cooling structure according to claim 1, wherein at least a portion of an EGR passage and/or fuel passage and/or transmission oil passage and/or lubricant engine oil passage and/or charged air passage is integrated in the flywheel housing.

5. The cooling structure according to claim 1, wherein at least a portion of a liquid coolant passage is integrated in the flywheel housing.

6. The cooling structure according to claim 1, wherein a pump for circulating the liquid coolant is provided in the flywheel housing.

7. The cooling structure according to claim 6, wherein the pump is mechanically driven by a belt from a flywheel.

8. The cooling structure according to claim 6, wherein the pump is electrically driven.

9. The cooling structure according to claim 6, wherein the pump is driven by a gearwheel connectable to the flywheel.

10. A vehicle comprising a cooling structure according to claim 1.

* * * * *